United States Patent [19]

Bullard

[11] Patent Number: 4,611,879

[45] Date of Patent: Sep. 16, 1986

[54] MODULAR BLOCK AND ELECTRICAL INTERFACE ASSEMBLIES EMPLOYING SAME

[75] Inventor: Peter H. Bullard, Skippack, Pa.

[73] Assignee: Dill Products Incorporated, Norristown, Pa.

[21] Appl. No.: 636,148

[22] Filed: Jul. 31, 1984

[51] Int. Cl.[4] ..... H01R 9/22

[52] U.S. Cl. ..... 339/198 H; 339/198 G

[58] Field of Search ..... 339/198 H, 198 R, 198 C, 339/198 G, 198 GA, 198 J, 198 S, 198 M

[56] References Cited

U.S. PATENT DOCUMENTS

| | | | |
|---|---|---|---|
| 2,326,327 | 8/1943 | Brewer . | |
| 2,463,826 | 3/1949 | Thacker | 339/198 H |
| 2,726,375 | 12/1955 | Gordon . | |
| 3,042,895 | 7/1962 | Bonhomme . | |
| 3,259,870 | 7/1966 | Winkler . | |
| 3,344,392 | 9/1967 | Briscoe . | |
| 3,358,266 | 12/1967 | Chandler et al. . | |
| 3,474,397 | 10/1969 | Piasecki . | |
| 3,771,104 | 11/1973 | Clark . | |
| 4,005,925 | 2/1977 | Sudre . | |
| 4,046,452 | 9/1977 | Cassarly . | |
| 4,171,862 | 10/1979 | Krasser . | |
| 4,269,470 | 5/1981 | Ustin . | |
| 4,343,528 | 8/1982 | Lucius . | |
| 4,466,687 | 8/1984 | Frantz | 339/198 H |
| 4,469,393 | 9/1984 | Chewning, Jr. et al. | 339/198 GA |

FOREIGN PATENT DOCUMENTS

| | | |
|---|---|---|
| 1952504 | 10/1969 | Fed. Rep. of Germany . |
| 1029090 | 5/1966 | United Kingdom . |
| 1064714 | 4/1967 | United Kingdom . |
| 1066672 | 4/1967 | United Kingdom . |
| 1089073 | 11/1967 | United Kingdom . |
| 1132584 | 11/1968 | United Kingdom . |

*Primary Examiner*—Gil Weidenfeld
*Assistant Examiner*—Thomas M. Kline
*Attorney, Agent, or Firm*—William H. Elliott, Jr.; Albert L. Free; Richard D. Weber

[57] ABSTRACT

A modular construction of an interface board for mounting electrical connectors comprises a plurality of interlocked modular blocks on which the connectors are mounted. Each side face of each block comprises one or more sets of locking elements which engage with a mirror-image set of locking elements on another of said blocks to prevent relative lateral motion between the blocks or structures. Motion of the blocks or structures away from each other, in a direction normal to their mated side faces, is prevented by providing a tapered mortise in each of said side faces, the adjacent mortises of adjacent interlocked blocks or structures being in mutually confronting, aligned relationship to each other so that the tenons of a double dovetail wedge can be inserted into both mortises simultaneously to hold them in fixed position. A resilient hooked projection integral with the wedge engages a detent in one of the block side faces when the wedge is fully inserted, to prevent its later loosening and accidental removal.

18 Claims, 22 Drawing Figures

MODULAR BLOCK AND ELECTRICAL INTERFACE ASSEMBLIES EMPLOYING SAME

BACKGROUND OF THE INVENTION

This invention relates broadly to modular blocks and to assemblies employing same; it is particularly useful in enabling the easy customized fabrication of electrical interface boards of the type in which electrical connectors are mounted on the board to enable easy interconnection between electrical elements. Such a customized interface board may, for example, be mounted on the firewall under the hood of an automotive truck; in a typical case, wires or cables, terminated in appropriate connectors, lead to the rear side of the board, the connectors being mounted within corresponding openings inside the various modular blocks. The front of the board will typically have plugged into it various electrical components, for example flashers, relays, or connectors on the ends of other wires, the terminals of these electrical elements typically being plugged into suitable standard openings provided on the front face of the interface board.

Such general types of arrangement being well known, it will not be necessary to describe in detail their typical constructions and uses. Suffice it for the present purpose to point out that the optimum configurations of such boards differ substantially from each other depending on the particular application, for instance with respect to the height and width of the board, the position and nature of its mounting arrangements, the number of connections to be made to it, etc.

Accordingly, for many purposes it is desirable to provide suitable modular blocks and structures which can readily be combined with each other in side-by-side arrangements so as to produce the size, shape and complexity of interface board which is best for any particular application. This makes it possible to utilize mass production techniques to make large quantities of a relatively small number of types of modular blocks and associated structures, with the usual economies of mass production, and then assemble them as desired into customized interface boards suitable for each particular application.

It is also desirable that such modular blocks and structures be inexpensive to make and easy to assemble to each other, without requiring complicated mounting procedures or mounting devices, and in fact it is desirable to be able to assemble such a customized board of strong reliable construction using simple manual assembly steps and without requiring any special tools.

It is therefore an object of the invention to provide a new and useful modular block suitable for use in an electrical interface board, and to provide assemblies of such modular blocks with other modular blocks or structures to produce desired forms of customized interface boards.

Another object is to provide such modular blocks, structures and interface boards which are inexpensive to manufacture, easy to assemble, yet capable of a large variety of customized configurations.

A further object is to provide a new and useful locking system for enabling the easy manual assembly of such blocks to other blocks or structures.

SUMMARY OF THE INVENTION

These and other objects and features of the invention are achieved by the provision of a modular block, having at least one side face provided with at least one set of integral locking elements; all side faces of the modular block are preferably provided with identical sets of such integral locking elements. Each such set of locking elements comprises at least one bar-like land and one corresponding groove of a size snugly to receive such a land, so that the lands and grooves of another such modular block or structure will be alignable and matable with the lands and grooves of the first said modular block, thereby to lock two so-assembled blocks against sideways motion normal to the direction of the bars and grooves. Preferably the set of locking elements also comprises at least first and second abutment means symmetrically positioned on said one face of the modular block so as to mate with corresponding abutment means on other similar modular blocks or structures, whereby when a modular block is placed in mating engagement with another modular block or structure, these abutment means prevent relative motion of the blocks or structures with respect to each other along the direction of the lands and grooves. In addition, each such side surface of the modular block is provided with a dovetail mortise, symmetrically disposed with respect to the centerline of the set of locking elements, so that when two such sets of locking elements are placed in confronting relationship the two mortises will be in aligned confronting relation to each other. A double-sided locking wedge having two identical dovetail tenons on its opposite sides is slidingly advanced into the two confronting mortises, one tenon on each mortise, until it achieves a locked position which also locks the adjacent modular blocks or structures from motion along directions perpendicular to the adjacent side faces of the blocks. The adjacent blocks or structures are thereby locked into position against motion in any direction, using only simple manual assembly steps and parts which are easily made by simple plastics molding procedures.

In a preferred embodiment, the wedge is tapered gradually downwardly in the direction of its insertion into its corresponding mortise so as to enable its easy entrance wedging into position in the mortises, and preferably the wedge comprises an integral hooked projection which cooperatively engages a detent shoulder on the modular block or other structure when the wedge is fully inserted, so as to assure against its removal. Also preferably, the first and second abutment means comprise an outwardly-extending, rearwardly-facing shoulder adjacent to the end of the groove in the side face of the block or structure, and a second inwardly-extending, forwardly-facing shoulder adjacent to the corresponding end of the bar-like land.

Each set of locking elements is preferably symmetrical about a centerline through it, extending parallel to the side faces on which the set of locking elements is located, so that by advancing one block toward the other, the lands and grooves of the locking elements will mate properly with each other. In some cases the blocks may be longer than they are wide, and there may be more than one set of such locking elements along the longer sides, in which case the locking elements should again be provided with such symmetry of location that another block having one or more sets of locking elements of the same configuration will provide the desired interlocking of lands and grooves and proper placing of abutments and mortises to effect the above-described interlocking action and condition.

BRIEF DESCRIPTION OF THE DRAWINGS

These and other objects and features of the invention will be more readily understood from a consideration of the following detailed description, taken in connection with the accompanying drawings, in which.

DETAILED DESCRIPTION OF SPECIFIC EMBODIMENTS

Figure 1:
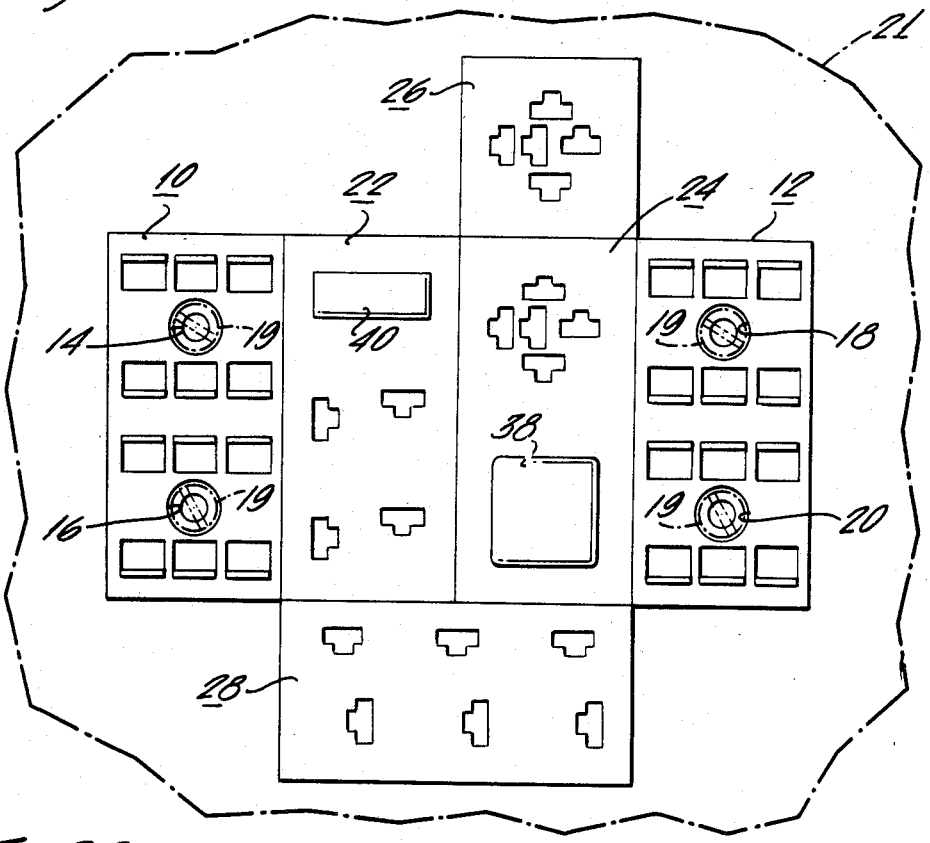
FIG. 1 is a schematic elevational view showing one of many possible forms of interface board in which the modular blocks of this invention may be employed.

Without thereby in any way limiting the scope of the invention, reference is now made to the drawings for a description of preferred embodiments of the invention, in which FIG. 1 shows schematically an interface board utilizing an assembly of interlocked modular blocks in accordance with one form of the invention. In this example each of the two rectangular end blocks 10 and 12 contains a pair of counter-bored mounting holes, designated 14, 16 and 18, 20, respectively. Suitable mounting screws 19 can be inserted through the holes and screwed into corresponding threaded mounting holes on a supporting frame 21, which may, for example, be an interior wall of an engine compartment.

This example shows, merely by way of illustration, the use of four side-by-side rectangular modular blocks 10, 22, 24 and 12, a square block 26 mounted to one end of rectangular block 24, and a further rectangular block 28 mounted to the ends of blocks 22 and 24. It is to be understood, however, that the modular blocks may be assembled in many different ways other than those shown; for example, the rectangular blocks may be mounted to each other in end-to-end configurations, and the square block may be mounted to the short side of either half of a long side of any of the rectangular blocks. In this way of a broad range of different sizes and configurations of interface boards may be built up, suitable for different applications. Another configuration and arrangement of interface board is shown, for example, in FIG. 22, and will be referred to in detail later herein.

Figure 2:
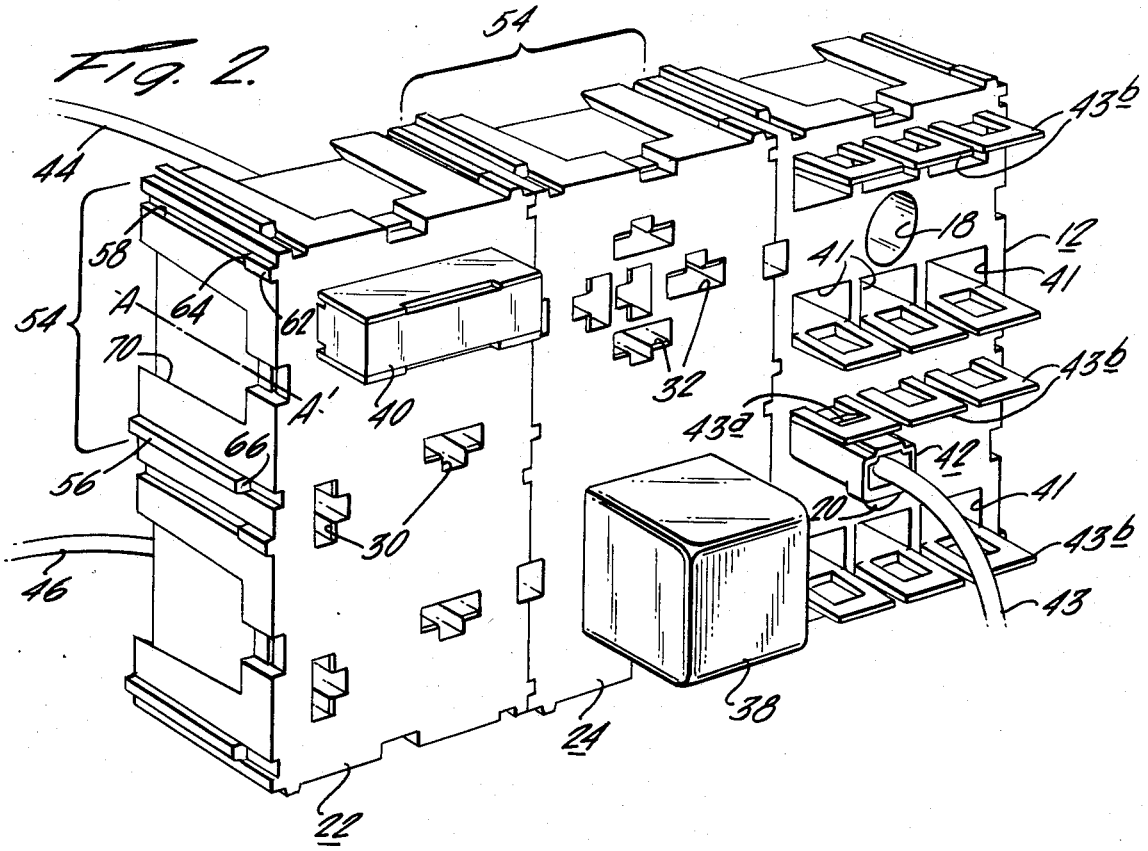
FIG. 2 is a perspective view showing three modular blocks of the interface board of FIG. 1, locked together along their longer side surfaces.

Turning now to FIG. 2, which shows in more detail the modular blocks 22, 24 and 12 of FIG. 1, each of the blocks has a front face, facing the viewer in FIGS. 1 and 2, a rear face on its opposite side, and four side faces. The front faces of blocks 22 and 24 are provided with suitable conventional plug-in socket openings such as 30 and 32, into which one may plug any of various electrical elements such as the relay 38 and the circuit breakers 40. Block 12 is provided with nine sockets such as 41 into which may be inserted terminal connectors such as 42, secured to the ends of wires such as 43; suitable spring clips such as 43A may be provided in the connectors, and suitable detent structures such as 43B may be provided, extending from the front of block 12, to hold the connectors such as 42 in position once inserted in place, as shown.

Figure 6:
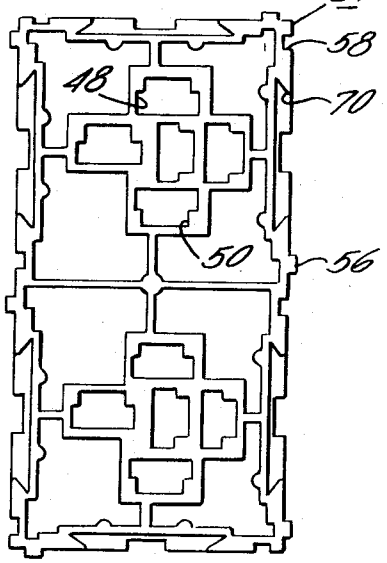
FIG. 6 is a rear elevational view of the modular block of FIG. 3.
Figure 8:
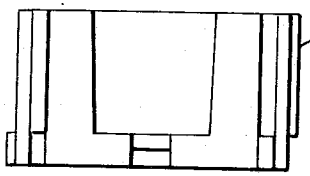
Figure 5:
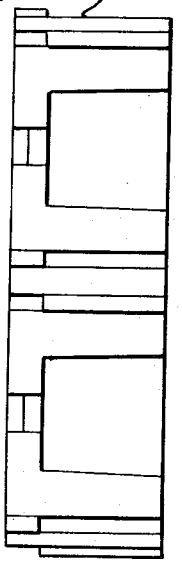
FIG. 5 is a right side diagonal view of the block of FIG. 3.
Figure 3:
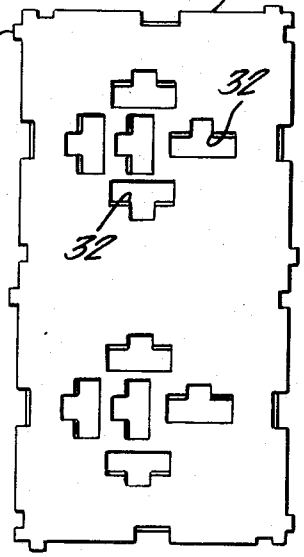
FIG. 3 is a front elevational view of a central block in FIG. 1.
Figure 4:
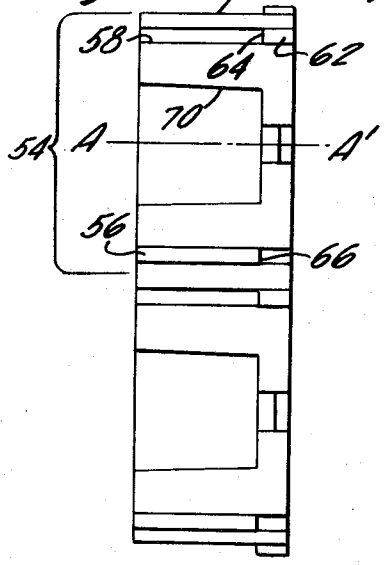
FIG. 4 is a left side elevational view of the modular block of FIG. 37.

In the usual case, electrical wires or cables such as 44,46 are brought to the rear of the modular blocks, and conventional female terminal connectors on the ends of such wires are inserted into openings such as 48,50 (FIG. 6) wherein they may be retained by spring action in a conventional manner; because of their conventional nature, the male and female connectors are not shown or described herein in detail, it being understood that the terminals, contained within the blocks, constitute female electrical connectors to which connection may be made by the insertion of male plug-in elements into the front faces of the modular blocks. It would be obvious that either male or female terminals may be employed in the blocks as desired.

Considering now in more detail the structure for locking the blocks to each other, and referring particularly to FIG. 2, each modular block comprises, along its side faces, sets of locking elements such as set 54 in FIG. 2. It will be seen that in FIG. 2 there are two such sets of locking elements along each of the longer sides of the rectangular blocks and one such set along each of the shorter side faces, each set being identical with the other and the block in this example being substantially twice as long as it is wide.

Each set such as 54 comprises a bar-like land such as 56 extending parallel to the front-to-rear dimension of the modular block and protruding from its side face on one side of the front-to-back center line A-A′ of that set of locking elements. Also provided is a groove 58 extending parallel to the bar-like land 56, the groove and the land being equidistant on opposite sides of the centerline A-A′. Groove 58 is of transverse dimensions such as to snugly receive within it a bar-like land identical with land 56, integrally formed on another side face of one of the other blocks. Also provided is a first abutment means 62 providing a rearwardly-facing shoulder 64, and a second abutment means 66 positioned on the opposite side of the centerline A-A' and comprising a shoulder facing forwardly on the end of land 56 the first and second abutment means are disposed equidistantly from and on opposite sides of the center line A-A', so that when a pair of the blocks are placed with their locking elements in mating engagement with each other, these first and second abutment means are thereby positioned adjacent corresponding abutment means of the adjacent block with which it is mated, thereby to prevent sliding motion of one block with respect to the other in either direction parallel to the lands and grooves.

Also provided are means for preventing relative motion between the modular block and the block with which it is mated along directions perpendicular to the side faces of the blocks, thereby to prevent them from separating from each other. These comprise, in the first set of locking elements 54, a dovetail mortise 70 recessed into the side edge of block 22, in this case configured symmetrically with respect to the centerline A-A'. When a pair of the modular blocks are placed in mating engagement, the mortises of the two will therefore be placed in aligned confronting relationship, so as to provide between them an opening into which the locking wedge to be described hereinafter may be pressed to lock the adjacent blocks to each other against parting motion thereof. Accordingly, by placing the selected modular blocks in mating engagement to provide the interface board desired, and then inserting the locking wedges into place, a customized interface board may be provided at low cost, without requiring special assembly techniques or tools.

The details of exactly how these locking elements may be configured and how they are secured together will be more readily understood, in this representative embodiment, with particular reference to FIGS. 10–17.

Figure 13:
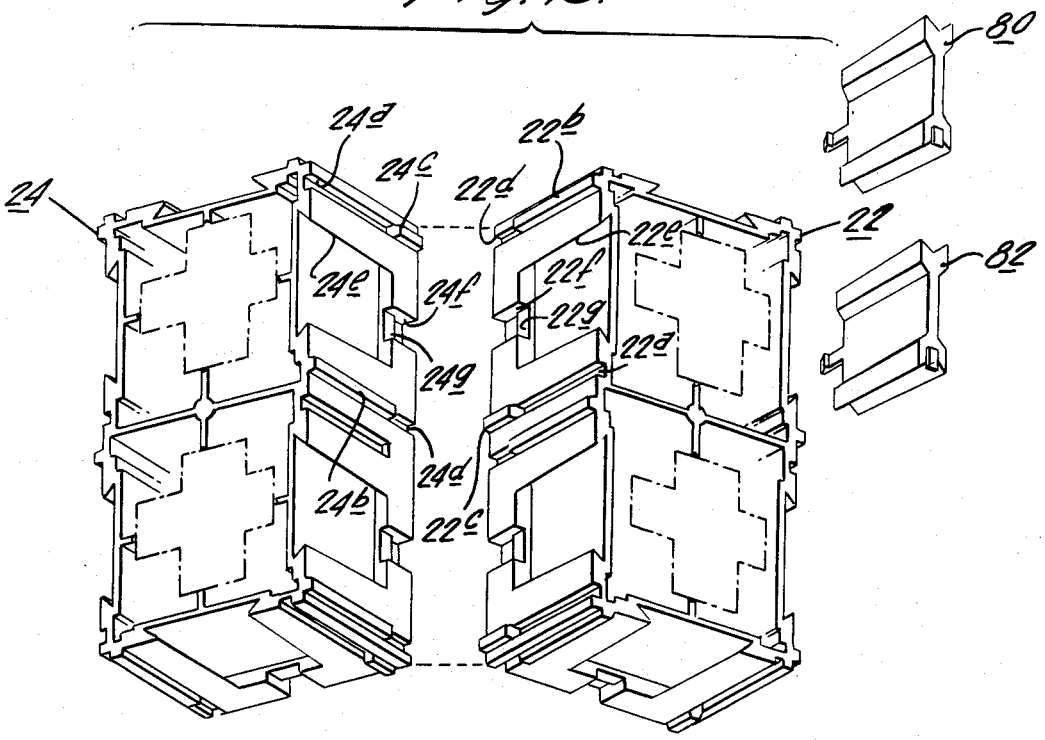
FIG. 13 is an exploded perspective view of two modular blocks such as are shown in FIGS. 3–8, together with their associated locking wedges.
Figure 14:
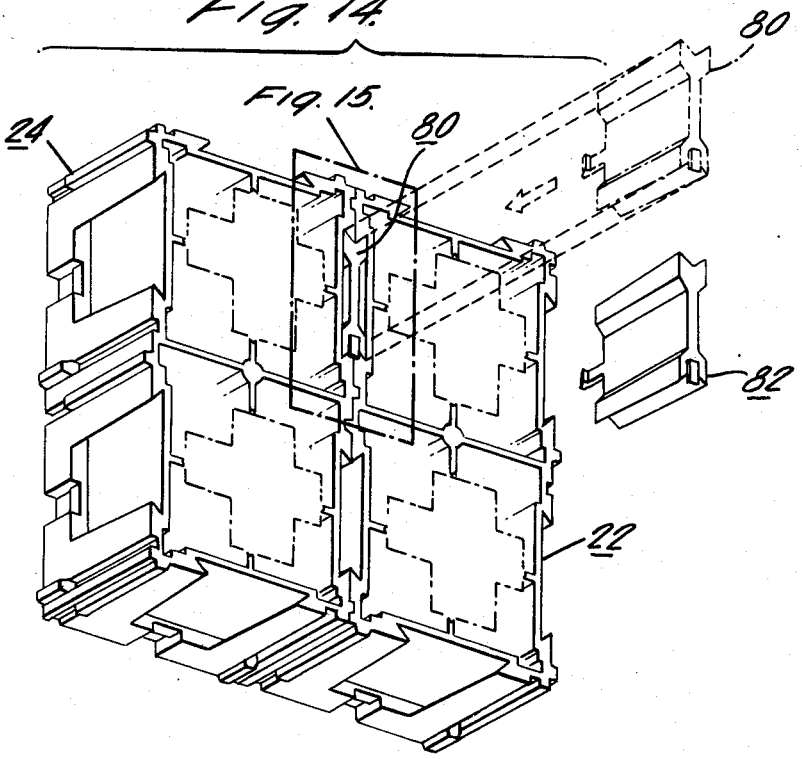
FIG. 14 is a view similar to FIG. 13, but showing the modules in their assembled, interlocked position, with the upper wedge in place and with the lower wedge not yet inserted, the position of the upper wedge prior to its insertion being shown in broken lines.

The manner in which two adjacent sets of locking elements mate with each other is shown particularly clearly in FIGS. 13 and 14, which illustrate rectangular blocks 22 and 24 in rear perspective views. It will be seen that the adjacent side edges of the two blocks each comprise two sets of identical locking elements, the blocks being so oriented that the locking elements of block 22 correspond to a mirror image of those of block 24. This is because the locking elements repeat themselves, in order, along a path extending around the circumference of the edge of each block, with the result that for any given block each set of locking elements on one side face is the mirror image of the set on the directly opposite side face.

Referring more particularly to the top sets of locking elements on the adjacent side faces of the blocks of FIG. 13, there are shown the groove 24*a*, the bar-like land 24*b*, the first abutment means 24*c* having a rearwardly facing shoulder, the recess 24*d*, the mortise recess 24*e*, the cut-out region 24*f* and the detent shoulder 24*g* which as described hereinafter is used in connection with locking the wedge into place. The corresponding elements of block 22 are identified by the numeral 22 followed by a suffix letter corresponding to the suffix letters for the corresponding parts of block 24.

It will therefore be seen that when the two blocks of FIG. 13 are placed together, with their adjacent side surfaces aligned with each other, land 22*b* will fit snugly into groove 24*a* and abutment means 24*c* will fit snugly into recess 22*d*; land 24*b* will fit snugly into groove 22*a*, with abutment means 22*c* fitting into recess 24*d*. The mortise recesses 24*e* and 22*e* will then be aligned with each other and in closely confronting positions, as will be the recesses 22*f* and 24*f*. The engagement of land 22*b* in groove 24*a* and engagement of land 24*b* in groove 22*a* will prevent motion along directions perpendicular to these lands and grooves, and the adjacent positions of abutment means 24*c* and the end face of land 22*b*, as well as the corresponding arrangement of abutment means 22*c* and the end face of land 24*b*, will prevent relative motion of the two blocks along directions parallel to the lands and grooves by the abutment of one end of each of the lands against the corresponding adjacent abutment means.

Figure 16:
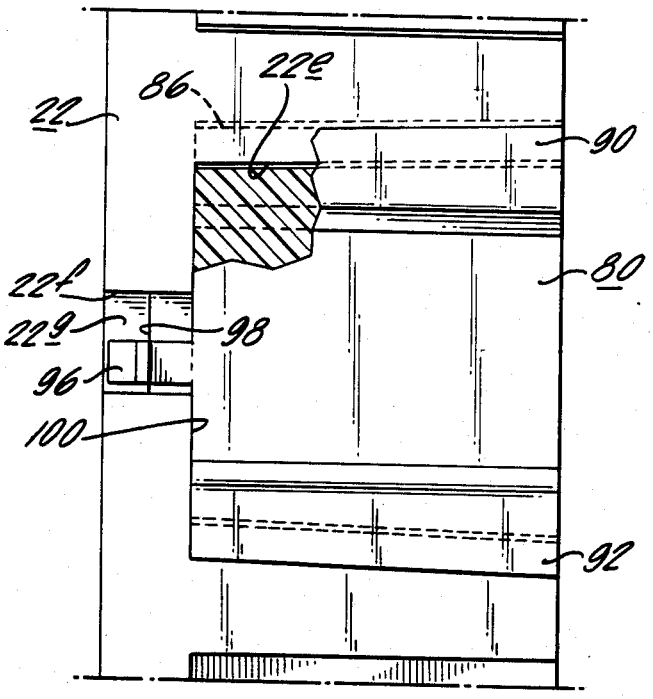
FIG. 16 is a sectional view taken along lines 16–16 of FIG. 15.
Figure 17:
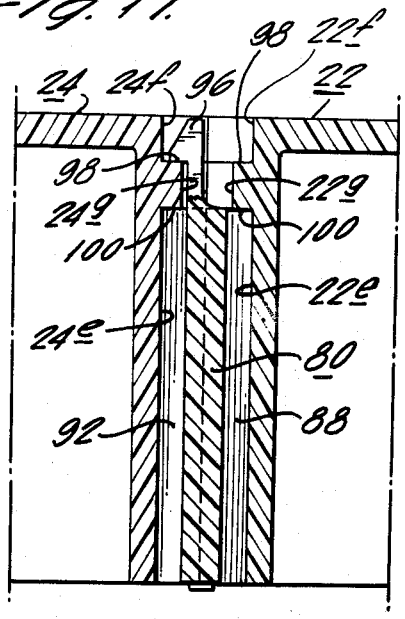
FIG. 17 is a sectional view taken along lines 17–17 of FIG. 15.

FIG. 14 shows the same two blocks 22 and 24 in mating engagement with each other, and illustrates how the locking wedges, in the form of double dovetailed wedges 80 and 82, are inserted into their corresponding mortises to lock the two blocks together against parting motion. In brief, each locking wedge is held aligned, as shown, and advanced to insert it into the mortises, wherein it is pressed until it wedges itself tightly within the mortises and achieves a locked position therein. The form of the mortises and wedges, and the nature of their locking action, will be more fully appreciated first from a consideration of the wedge itself as shown in FIGS. 10–12, and then from a consideration particularly of FIGS. 15–17 showing a wedge in locked position.

Figure 10:
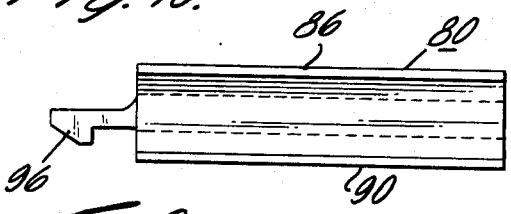
FIG. 10 is a side view of the wedge of FIG. 9.
Figure 11:
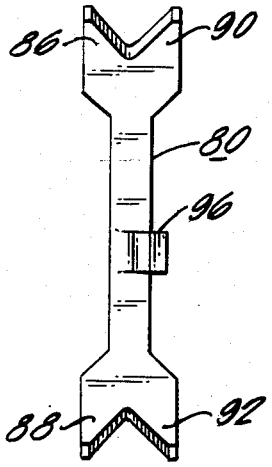
FIGS. 11 and 12 are end views of the wedge of FIG. 9, as seen from the left and right respectively.
Figure 9:
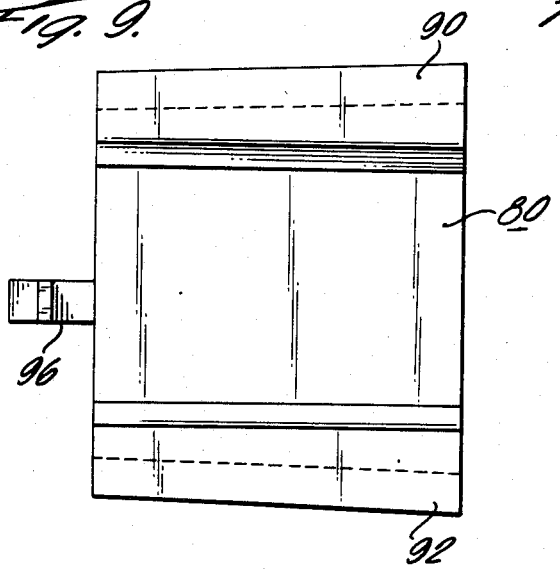
FIG. 9 is an enlarged elevational plan view of the locking wedge utilized in the assembly of FIG. 2.
Figure 12:
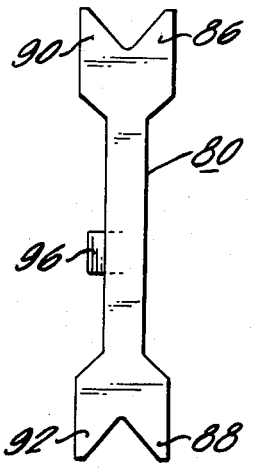
Figure 7:
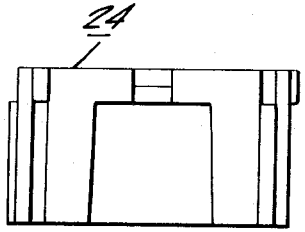
FIGS. 7 and 8 are top and bottom views, respectively, of the modular block of FIG. 3.

Referring to the showing of FIGS. 10–12 of the typical locking wedge 80 as shown in FIG. 10 in plan view, its side edges taper downwardly in wedge-like fashion toward the left in FIG. 10, which is the direction of its insertion. As noted previously, the corresponding mortises such as 24*e* and 22*e* are also tapered in this same direction. These tapers provide for easy entry of the smaller ends of the wedges into the mortises; the mortises preferably have slightly greater taper than the wedges so that, as the wedge approaches its fully inserted position, there is a binding action between wedge and mortise which tends to hold the wedge tightly in place after it is fully inserted with its front end abutting the inner end of the mortise.

As seen clearly in FIGS. 11 and 12, the wedge is in the form of a double-sided wedge having two identical dovetail tenons 86,88 and 90,92 on its opposite side edges. It also comprises an integral resilient hooked projection 96 extending from near the middle of its forward end, used to achieve further positive locking, as will presently be described.

Figure 15:
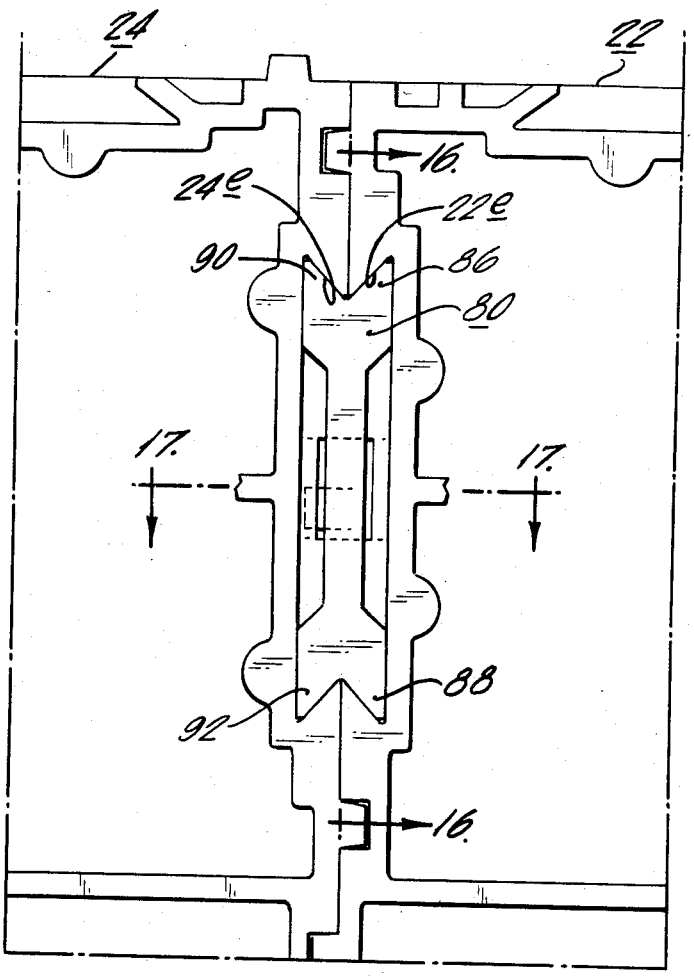
FIG. 15 is an enlarged fragmentary plan view of the portion of FIG. 14 adjacent the interlocking surfaces, with the locking wedge in place.

Referring now particularly to FIG. 15 showing the locking wedge in place, to an enlarged scale, it is seen that tenons 86 and 88 serve as a dovetail inserted in the mortise 22*e* of block 22, while tenons 90 and 92 provide a dovetail fit into mortise 24*e* of block 24. The wedge therefore provides two dovetail arrangements, one on each side of the center of the wedge, each mating with a mortise on one of the two adjacent blocks so as to hold the blocks locked against parting motion.

In FIGS. 15–17, the wedge 80 is shown fully inserted, so that its forward end abuts against a shoulder 100 at the bottom of the mortise. Furthermore, the hooked end of the projection 96 flexes sufficiently during its insertion to pass the boss 100 on the block 24, and in the position shown has sprung back so that its hooked end engages with the shoulder detent 98 to prevent subsequent withdrawal or accidental pulling out of the wedge after it has been fully inserted to the position shown in FIG. 17.

Recapitulating, to assemble one block to the next, the locking elements thereof are merely aligned with each other and pressed together and, while so held, locked together by insertion into the mortises of the tenons of the dove-tailed wedge until the wedge seats fully and the hooked end of its resilient projection has engaged the detent to prevent its subsequent withdrawal. In this way any desired type of interface board may be built up, such as that shown in FIG. 1.

Figure 22:
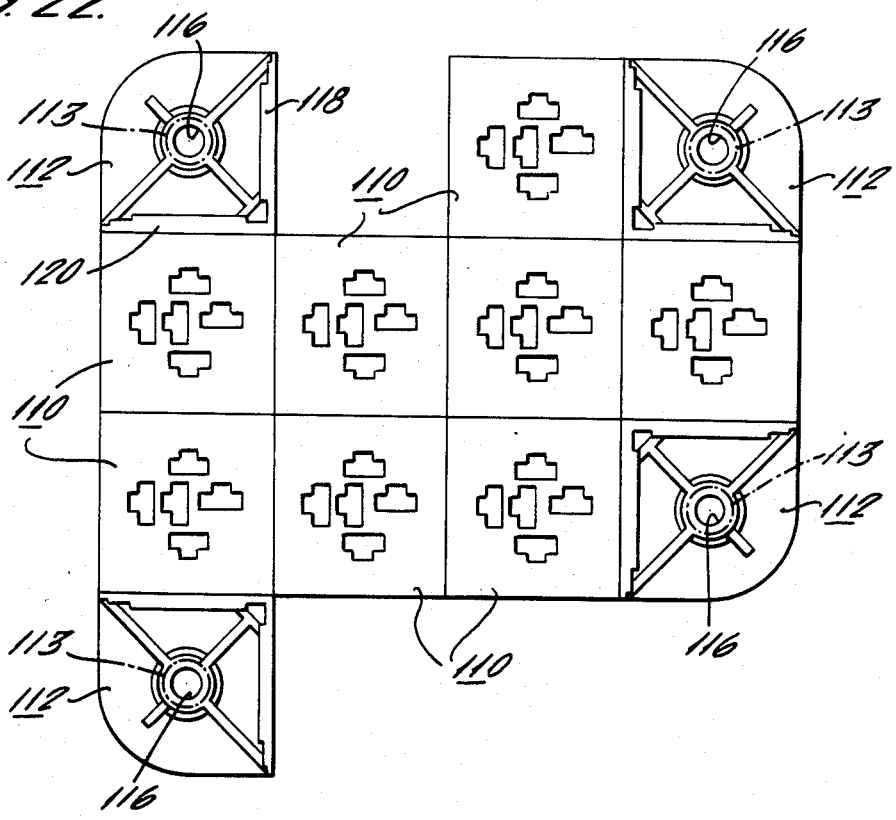
FIG. 22 is a schematic front view of an alternative form of interface board using the assembly of FIG. 18.

Another type of interface board which can be similarly put together by means of the present invention is shown schematically in FIG. 22, which is made up entirely of square blocks such as 110 plus four mounting structures such as 112 each having sets of locking elements on those side surfaces thereof which engage the adjacent square blocks.

Figure 18:
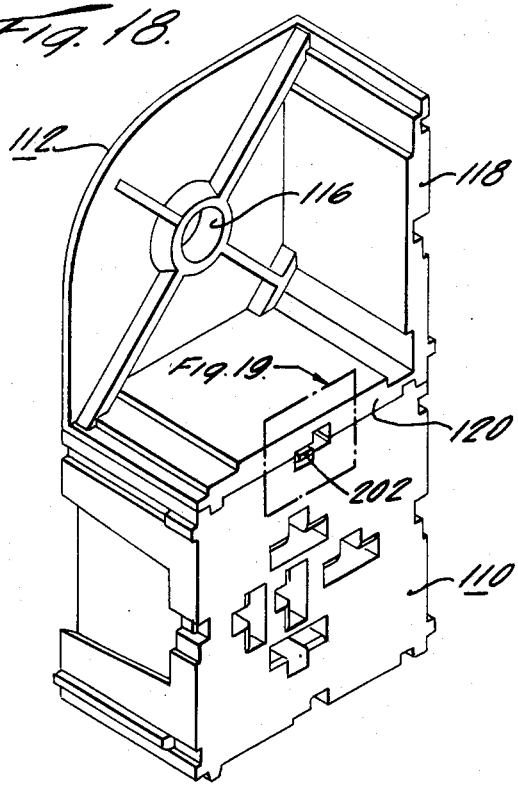
FIG. 18 is a perspective view showing an alternative form of the modular block, locked to an alternative form of mounting structure.
Figure 19:
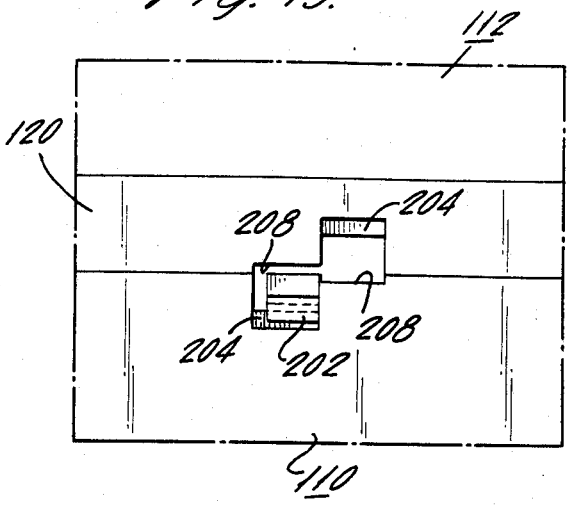
FIG. 19 is an enlarged fragmentary view of the portion of FIG. 18 within the broken-line square.
Figure 20:
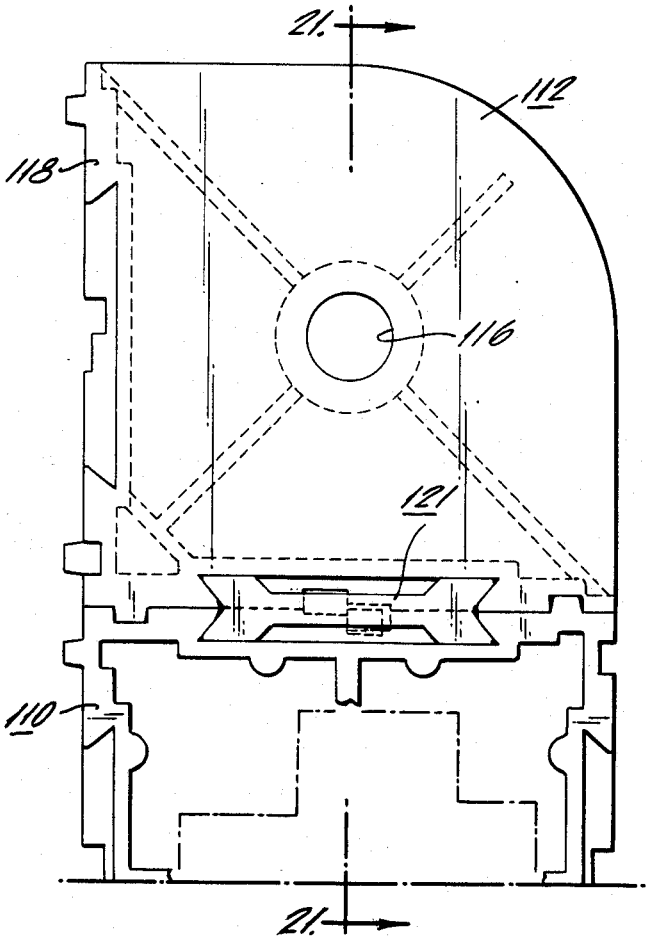
FIG. 20 is an enlarged fragmentary rear elevational view of the assembly of FIG. 18.
Figure 21:
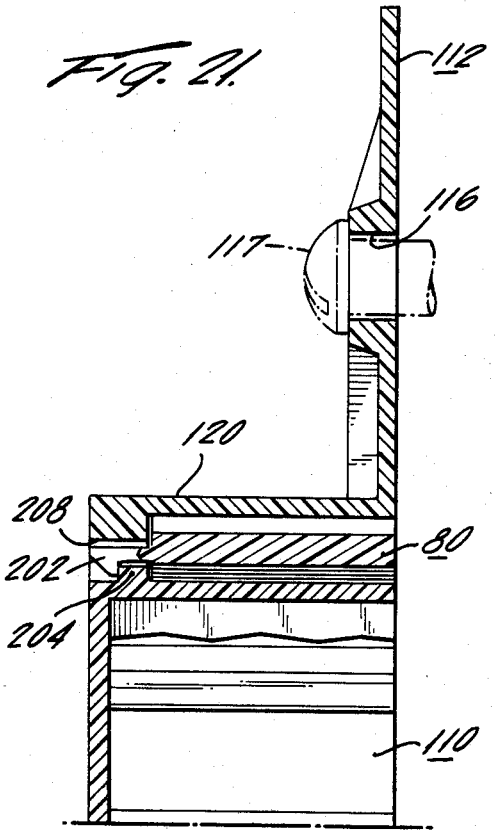
FIG. 21 is a sectional view taken along lines 21–21 of FIG. 20.

FIG. 18 shows the representative square block 110 of FIG. 22, and the adjacent representative mounting block or structure 112. Structure 112 is provided with a suitable through-bore at 116 in which a suitable mounting screw 117 (FIG. 21) may be inserted. Each of its two side faces 118 and 120 is provided with a set of locking elements identical with those of the square blocks adjacent it, including block 110.

FIGS. 18–21 also show a modified and preferred arrangement of the locking projection and detent for holding the locking wedge 121 securely in place once fully inserted. As shown, the resilient locking projection 202 is off-center, as is the detent 204 with which it engages, so that the wedge must be turned to the correct one of its two reversible positions in order for the projection to line up with the detent during and after its insertion. Immediately adjacent the detent is a relief 208 of lesser depth than the detent which, when the blocks are mated, leaves an opening behind the resilient projection just sufficient to permit the projection to be forced into its final position, engaging the detent. With this arrangement the projection cannot readily be bent back sufficiently to clear the detent after it is once installed, providing a more permanent final structure.

While the invention has been described with respect to specific embodiments in the interest of complete definiteness, it will be understood that it may be embodied in a variety of forms differing substantially from those shown and described, without departing from the spirit and scope of the invention as defined by the appended claims.

What is claimed is:

1. A modular block for assembly with one or more other blocks into an electrical interface board of the type in which electrical connectors are mounted on the board for enabling interconnection between electrical elements in contact with said connectors, said modular block comprising a front face, a rear face, and a plurality of side faces, wherein at least one of said side faces comprises at least one set of integral locking elements configured to mate with and be secured to a corresponding set of integral locking elements on another side face of another of said blocks, said one set of locking elements comprising:

a bar-like land extending parallel to the front-to-rear dimension of said modular block and protuding from said one side face on one side of the front-to-back centerline of said set of locking elements, and a groove in said one side face extending parallel to said land on the opposite side of said centerline, said land and said groove being equidistant from said centerline and said groove being of transverse dimensions such as to receive another land protruding from another side face of said other block and having the same dimensions as said bar-like land, whereby said one side face of said modular block and said other side face of said other block may be positioned in mating engagement, with the land of one snugly seated in the groove of the other, thereby to prevent relative motion between said modular block and said other block along lateral directions perpendicular to said centerline;

first and second abutment means disposed on said one face on opposite sides of said centerline equidistant therefrom and dimensioned so that, when said locking elements of said one side face of said modular block are in mating engagement with corresponding locking elements on the one face of said other block, said first and second abutment means of said modular block are adjacent the corresponding abutment means of said other block to prevent relative motion of said modular block and said other block in a direction parallel to said centerline; and means for preventing relative motion between said modular block and said other block along directions perpendicular to said one side face of said modular block, comprising a dovetail mortise centered on said center-line of said one side face between said groove and said land and between said first and second abutment means of said modular block, for slidingly receiving one dove-tail tenon of a double-sided wedge having two identical dovetail tenons on its opposite sides when said double-sided wedge is advanced into said mortise along a direction parallel to said one side face of said modular block, the other dovetail tenon of said wedge being adapted similarly to enter a corresponding identical mortise on said other side face of said other block thereby to hold said one modular block and said other block tightly in said mating engagement.

2. The modular block of claim 1, wherein said plurality of side faces of said modular block comprises three side faces in addition to said one side face, and each of said three additional side faces comprises a set of locking elements substantially identical with those on said one face.

3. The modular block of claim 2, wherein said modular block is a rectangular block.

4. The modular block of claim 3, wherein one pair of opposite side faces of said modular block are twice as long as the other pair of opposite side faces, and each of said one pair of opposite side faces comprises two sets of said locking elements, said two sets being disposed in tandem along the length of each said longer side face of said one pair.

5. The modular block of claim 2, wherein said modular block is a square block, each of the three additional side faces thereof being of a length equal to that of said one side face and each comprising a set of locking elements substantially identical to said one set.

6. The modular block of claim 1, wherein said first abutment means comprise a first rearwardly-facing shoulder at the front end of said groove of said one set of locking elements, and said second abutment means comprises a second frontwardly-facing shoulder at the front end of said land of said one set of locking elements.

7. The modular block of claim 1, wherein said mortise tapers downwardly in width, along the direction of insertion of said wedge.

8. The modular block of claim 1, comprising an integral locking detent for receiving and locking in position a flexible hooked projection on said wedge when said wedge is fully inserted into said mortise.

9. The modular block of claim 1, wherein said dovetail mortise is open to insertion from the direction of said rear face, said modular block comprising a further abutment adjacent its front face for arresting the sliding movement of said wedge when it is fully inserted into said mortise.

10. An interlocking assembly comprising a modular block having a front face, a rear face and a first side face on which a first set of locking elements is integrally formed, and another structure having another side face on which a second set of locking elements is integrally formed, each of said first and second sets of locking elements being symmetrically located with respect to a centerline in the side face in which that set of locking elements is formed, said first set and said second set being substantially mirror images of each other;

each of said first and second sets of locking elements comprising protruding bars and corresponding grooves, the bars of said first set of locking elements engaging in the grooves of the corresponding said second set of locking elements to prevent relative motion of said block and said structure laterally of said grooves and bars;

each of said first and second sets of locking elements comprising abutment means associated with their respective bars and grooves and engaging corresponding abutment means of the other set of locking elements, for preventing relative motion of said block with respect to said structure along the direction of said bars and grooves;

said first and second sets of locking elements also comprising respective first and second dovetail mortises shaped to receive slidingly a dovetailed wedge by sliding motion of said wedge along the direction parallel to said first side face, the mortises of said block and of said structure being in confronting aligned relationship to each other; and a double-sided wedge having two identical dovetail tenons on its opposite side, said wedge being inserted into said mortises with one of said tenons in one of said mortises and the other tenon in the other said mortises.

11. The assembly of claim 10, wherein said structure is another block identical with said modular block.

12. The assembly of claim 10 comprising a frame, and wherein said structure contains a mounting hole for mounting said structure and said modular block to said frame.

13. The assembly of claim 10, wherein said mortises and said tenons are tapered downwardly in width along the direction of insertion of said wedge.

14. The assembly of claim 10, wherein said wedge comprises a flexible hooked projection at its forward side and said block comprises an integral locking detent for receiving and locking in position said flexible hooked projection on said wedge when said wedge is fully inserted into said mortise.

15. The assembly of claim 10, wherein said dovetail mortise is open to insertion from the direction of said rear face, said modular block comprising an abutment adjacent its front face for arresting the sliding movement of said wedge when it is fully inserted into said mortise.

16. The assembly of claim 10, wherein said modular block comprises three side faces in addition to said one side face, each provided with corresponding sets of locking elements identical with said first set of locking elements, said assembly also comprising additional structures each having at least one side face provided with at least one set of locking elements identical with said second set of locking elements, and three additional wedges each identical with said double-sided wedge and each inserted into a mortise of said modular block and into a mortise of one of said additional structures, thereby to mount said additional structures on all four side faces of said modular block.

17. An interface board comprising a plurality of modular blocks each having a front face, a rear face and four side faces, each of said blocks having at least one set of integral locking elements on at least one of its side faces engaging another identical set of locking elements on another of said blocks, each of said sets of locking elements comprising lands and grooves for preventing relative lateral motion of adjacent blocks along a direction perpendicular to said lands and grooves, said lands and grooves forming first and second abutment means for preventing relative motion of adjacent blocks along directions parallel to said lands and grooves, each side face of each of said blocks comprising a tapered dovetail mortise for slidingly receiving one tenon of a double-sided dovetail wedge, said wedge comprising two dovetail tenons, one at each of its opposite sides, one of said tenons extending into the mortise on one of said blocks and the other tenon extending into the mortise of an adjacent block to prevent relative motion of said one block and said other block from each other.

18. The board of claim 17, wherein at least one of said blocks comprises a bore extending through it for receiving a mounting fastener for mounting said board.

* * * * *